US005329957A

United States Patent [19]

Semchuck et al.

[11] Patent Number: 5,329,957

[45] Date of Patent: Jul. 19, 1994

[54] FLUID FLOW SYSTEM VACUUM BREAKER

[75] Inventors: Mario E. Semchuck; Reid H. Baker, both of Chatsworth, Calif.

[73] Assignee: Emhart Inc., Newark, Del.

[21] Appl. No.: 996,486

[22] Filed: Dec. 15, 1992

Related U.S. Application Data

[63] Continuation of Ser. No. 751,050, Aug. 28, 1991, abandoned.

[51] Int. Cl.[5] ..... E03C 1/10; F16K 24/02

[52] U.S. Cl. ..... 137/218; 137/217; 137/625.17

[58] Field of Search ..... 137/217, 218, 625.17

[56] References Cited

U.S. PATENT DOCUMENTS

| | | | |
|---|---|---|---|
| Re. 32,981 | 7/1989 | Marty . | |
| 2,394,911 | 2/1946 | Griswold . | |
| 2,587,960 | 3/1952 | Bletcher et al. . | |
| 3,056,418 | 10/1962 | Adams et al. | 137/217 X |
| 3,917,172 | 11/1975 | O'Hare . | |
| 4,221,337 | 9/1980 | Shames et al. | 137/625.48 X |
| 4,609,006 | 9/1986 | Parkison et al. . | |
| 4,696,322 | 9/1987 | Knapp et al. | 137/218 |
| 4,805,661 | 2/1989 | Knapp et al. . | |
| 4,827,538 | 5/1989 | Heimann et al. | 137/217 X |
| 4,969,483 | 11/1990 | Knapp | 137/217 X |
| 4,977,920 | 12/1990 | Oberdorfer | 137/218 |
| 5,009,247 | 4/1991 | Oberdorfer | 137/218 |
| 5,038,814 | 8/1991 | Gayton et al. | 137/218 |
| 5,060,687 | 10/1991 | Gayton | 137/218 |
| 5,079,781 | 1/1992 | Gnauert et al. | 137/218 X |
| 5,095,554 | 3/1992 | Gloor | 137/218 X |
| 5,103,856 | 4/1992 | Fleischmann | 137/218 |

FOREIGN PATENT DOCUMENTS

| | | | |
|---|---|---|---|
| 8813390 | 12/1988 | Fed. Rep. of Germany | 137/217 |

*Primary Examiner*—Gerald A. Michalsky
*Attorney, Agent, or Firm*—J. Bruce Hoofnagle

[57] ABSTRACT

A fluid flow system (20) includes fluid inlet conduits for supplying fluid through a fluid flow path (86) as formed by a manifold (74) and a module (76). The fluid is directed through fluid flow path (86) to a flexible conduit (54) and to a fluid dispensing wand (36) whereat the fluid can be selectively dispensed in a stream or a spray. A linking passageway (102) is formed by manifold (74) and module (76) to couple selectively the pressure of a pressurized environment, such as atmospheric pressure, to fluid flow path (86). An umbrella valve (104) is located in linking passageway (102) and is responsive to the development of a negative pressure at the fluid supply and thereafter couples the pressure of the pressurized environment to fluid flow path (86). This action neutralizes the effects of the negative pressure and precludes the reverse flow of fluid within fluid flow system (20).

14 Claims, 5 Drawing Sheets

FLUID FLOW SYSTEM VACUUM BREAKER

This is a continuation of application Ser. No. 07/751,050, filed Aug. 28, 1991, now abandoned.

BACKGROUND OF THE INVENTION

This invention relates to a fluid flow system with a vacuum breaker for use in faucet systems and particularly relates to a fluid flow system with an atmospheric vacuum breaker which is used in a faucet system to prevent the reverse flow of water from a contaminated source to a potable supply associated with the faucet system.

In one type of faucet system, a faucet spout is designed to support at its free end a removable water dispensing head which can function selectively to provide a stream of water therefrom in a stream mode or a spray of water therefrom in a spray mode. The dispensing head is connected to a flexible conduit which extends inwardly through the spout and is coupled to a potable water system through a valve of a conventional hot and cold water system.

In the stream mode, the valve is adjusted to provide the desired mix of hot and cold water which flows through the flexible conduit and exits as a water stream through the head which is supported at the end of the spout. In this manner, the head functions as a typical water-dispensing spout. When the head is used as a spray head in the spray mode, the head is removed from the spout and is pulled to draw the flexible conduit therefrom. A button on top of the head is depressed to adjust the head to function .in the spray mode whereafter the water is dispensed from the head in a spray.

Typically, a sink or basin is located below the spout and head. If, for example, dishes are washed in the sink, dirty and contaminated water will collect in the sink. If the head is placed in the dirty water in the sink during a period when the faucet valve is on and a negative pressure develops in the supply line, the dirty water could be drawn from the sink, through the head and flexible conduit, through the valve and into the supply line of the potable water system. Thereafter, if water is drawn from the supply line through any of the faucet systems in the house, a mix of contaminated and potable water will undesirably appear at the outlet or spout of the operated faucet systems. The negative pressure could develop, for example, because of a break in a main water line outside of the house or when a sudden and exceptional demand is placed on the main water supply such as by the fire department in extinguishing a fire nearby.

In the past, a variety of techniques have been employed to prevent the undesirable draw of contaminated water from the sink when negative pressure occurs in the supply line as described above. An example of one system for preventing the above-described reverse flow of water is disclosed in U.S. Pat. No. 4,696,322 which was issued to Alfons Knapp et al. on Sep. 29, 1987. In the faucet system disclosed in U.S. Pat. No. 4,696,322, a hollow spherical valve element is formed with water inlet ports to accommodate coupling to a hot water supply line and a cold water supply line. The valve element is further formed with an outlet port to facilitate supplying of a selected mix of hot and cold water therethrough.

As further illustrated in U.S. Pat. No. 4,696,322, the spherical valve element is formed by two half-spherical hollow elements which are joined and welded together to form a unitary hollow sphere. An anti-siphon back flow preventer is welded to the inside wall of one of the half-spherical elements and is thereby fixedly attached to and is then sealed within the spherical valve element after the two half-spherical elements are welded together.

The back flow preventer includes a chamber in which is mounted a flapper valve for normally covering a plurality of apertures formed through one wall of the chamber. A large opening of the chamber is covered by a snap ring which is formed with a smaller central aperture to thereby capture the flapper valve within the chamber. The plurality of apertures communicates through openings in the spherical valve element with the atmosphere surrounding the faucet system.

When the associated water supply is subjected to a positive pressure, the flow of water through the valve element causes the flapper valve to cover and seal the plurality of apertures. When the water supply is subjected to a negative pressure, and the dispensing head of the faucet system is located within dirty water with the valve positioned to allow water to flow, the dirty water tends to flow in a reverse direction through the spherical valve element. This action would result in the mixing of the dirty water with the potable water of the water supply within the supply line. However, with the development of the negative pressure and the tendency of the dirty water to flow in the reverse direction, the flapper valve is drawn away from the apertures to allow atmospheric pressure to be applied within the spherical valve element. In this manner, the atmospheric pressure neutralizes the effects of the negative pressure whereby the reverse flow of dirty water is prevented.

While the back flow preventer of U.S. Pat. No. 4,696,322 is effective to prevent the undesirable reverse flow of dirty water as noted above, the preventer is welded in place within the hollow spherical valve element. Further, the valve element is formed by two half sections which are welded together to permanently seal the preventer within the valve element as noted above. So, not only is the preventer welded in place, it is contained within an enclosure, that is the welded spherical valve element. Thus, when replacement of a defective valve element is necessitated, another preventer will be required in the replacement valve element because the original preventer is welded and sealed within the defective valve. Further, if the preventer is defective and requires replacement, the entire valve element must be replaced because the defective preventer is welded and sealed within the valve element.

In addition, the preventer as mounted within the valve element is constantly being moved when the valve element is moved to initiate or stop the supply of water therethrough. This movement subjects the flapper valve and the snap ring to sudden and sometimes violent forces which could possibly jar the flapper valve or snap ring from their mountings resulting in defective operation of the preventer.

Thus, there is a need for an inexpensive vacuum breaker system which can be inserted or removed with relative ease from the associated fluid flow system independently of the valve of the fluid flow system. Further, there is a need for an inexpensive vacuum breaker system which can be mounted removably in a fixed position at all times, including during use of the related fluid flow system, and not be subjected to forces resulting from the manipulation of the related valve of the fluid flow system.

SUMMARY OF THE INVENTION

It is, therefore, an object of this invention to provide a fluid flow system with a vacuum breaker which is relatively inexpensive to manufacture and to mount and maintain within the fluid flow system with relative ease.

Another object of this invention is to provide a fluid flow system with a vacuum breaker which is mountable in an essentially motion-free position within a fluid flow system at all times including periods when the system is in use.

With these and other objects in mind, this invention contemplates a fluid flow system with a vacuum breaker which includes an inlet flow line for receiving and conducting fluid therethrough and an outlet flow line for receiving and conducting fluid therefrom. Means, removably mounted in a fixed position during use of the fluid flow system between the inlet flow line and the outlet flow line and having a fluid flow path, are provided for conducting the flow of fluid in a first direction from the inlet flow line to the outlet flow line upon the application of a positive pressure sufficient to cause the fluid to flow in the first direction. Other means, removably mounted in a fixed position during use of the fluid flow system within the conducting means and responsive to the development of a negative pressure sufficient to cause fluid to flow in a direction opposite the first direction from the outlet flow line through the conducting means and out of the inlet flow line, are provided for coupling the fluid flow path to a pressurized environment which neutralizes the effect of the negative pressure and precludes the flow of fluid in the direction opposite the first direction.

DETAILED DESCRIPTION OF THE PREFERRED EMBODIMENT

Figure 1:
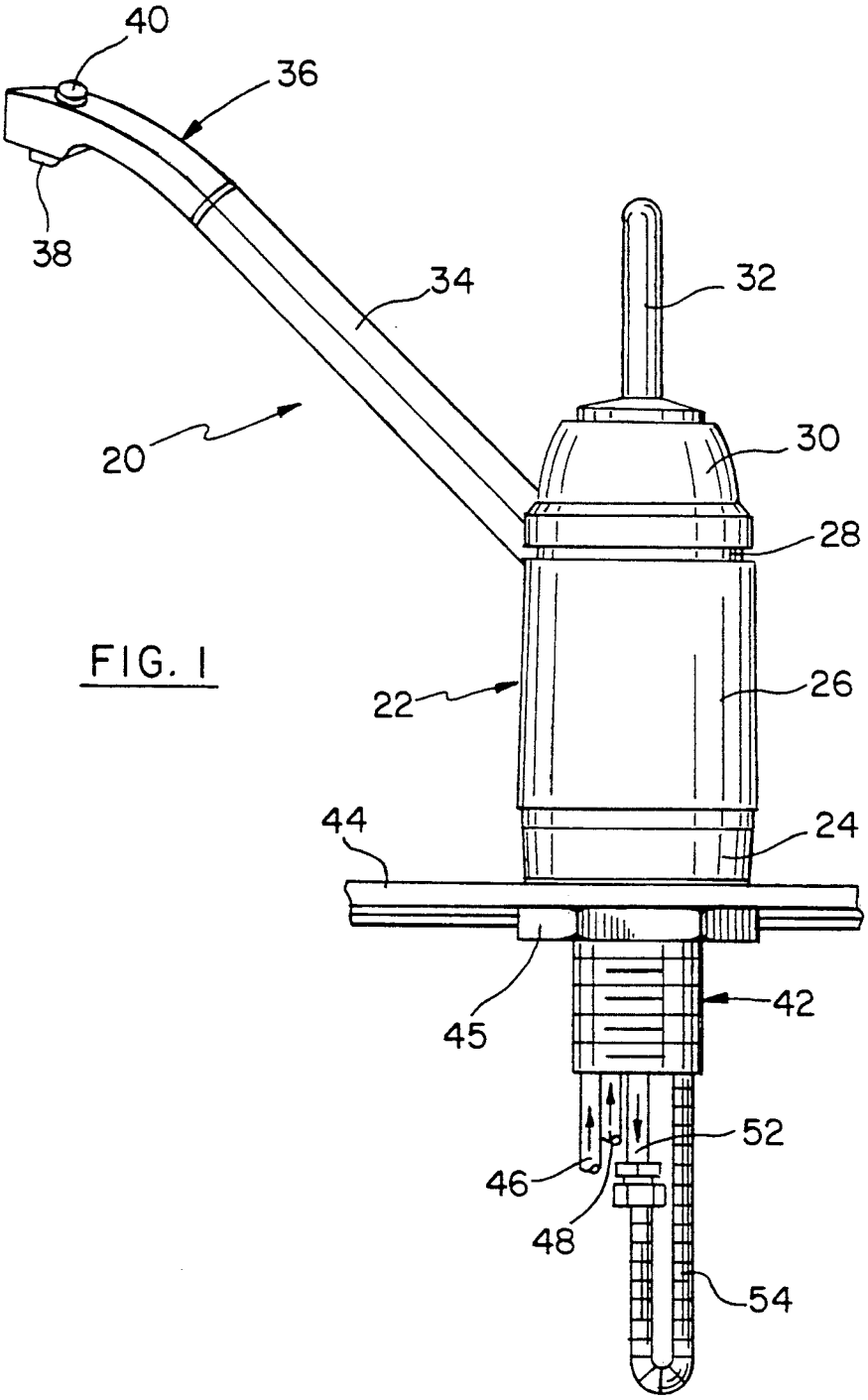
FIG. 1 is a side view of a faucet system.

Referring to FIG. 1, a fluid flow system 20 includes a spout support assembly 22. The faucet head 22 includes a base 24 upon which is mounted a hub 26. A valve body 28 is contained within hub 26 and a handle housing 30 with a handle 32 is located above the valve body.

A hollow spout 34 extends from hub 26 and supports at a free end thereof a fluid dispensing spray head 36. Spray head 36 includes a fluid dispensing nozzle 38 and a control button 40 which allows the user to place the wand in a stream mode or a spray mode. In the stream mode, fluid, such as water, is dispensed from the wand in a stream in the manner of dispensing water from a conventional spout (not shown). In the spray mode, fluid is dispensed in a spray.

A hollow fitting 42 extends downwardly from and is attached to base 24 and is formed with threads on the external surface thereof. The fluid flow system 20 is positioned on a sink support ledge 44, for example, with fitting 42 being inserted through an opening (not shown) in the ledge so that the fitting extends below the ledge. A nut 45 is threadedly positioned over fitting 42 to secure fluid flow system 20 with ledge 44.

Fluid is supplied to fluid flow system 20 through a pair of inlet conduits 46 and 48 which, for example, could supply hot and cold water, respectively. The supply of fluid is fed through conduits 46 and 48 to a valve 50 (FIG. 2) within body 28 where the fluid from the two conduits is mixed selectively depending upon the setting of handle 32.

The selected mix of fluid is then passed from valve 50 through an outlet conduit 52 and a flexible conduit 54 to the inlet side of spray head 36. Note that flexible conduit 54 is coupled to the outlet end of conduit 52 and is positioned within fitting 42 and spout 34 (FIG. 2) where the outlet end of the flexible conduit is coupled to the inlet end of spray head 36. Further, the inward end of spray head 36 is shaped to fit into the outward end of spout 34 so that the spray head is supported at the outward end of the spout in the position illustrated in FIG. 1. Typically, in this position, button 40 is normally in position, without operator depression, to allow spray head 36 and nozzle 38 to function in the stream mode. In this mode, the spout 34 can be swivelled in normal fashion to locate the dispensed stream of fluid where desired.

Spray head 36 can be withdrawn selectively from its mount within spout 34. Flexible conduit 54 is provided with ample length (FIG. 1) to allow spray head 36 to be moved to a location spaced from the outward end of spout 34. Button 40 can be operated to place spray head 36 in the spray mode if desired.

Figure 2:
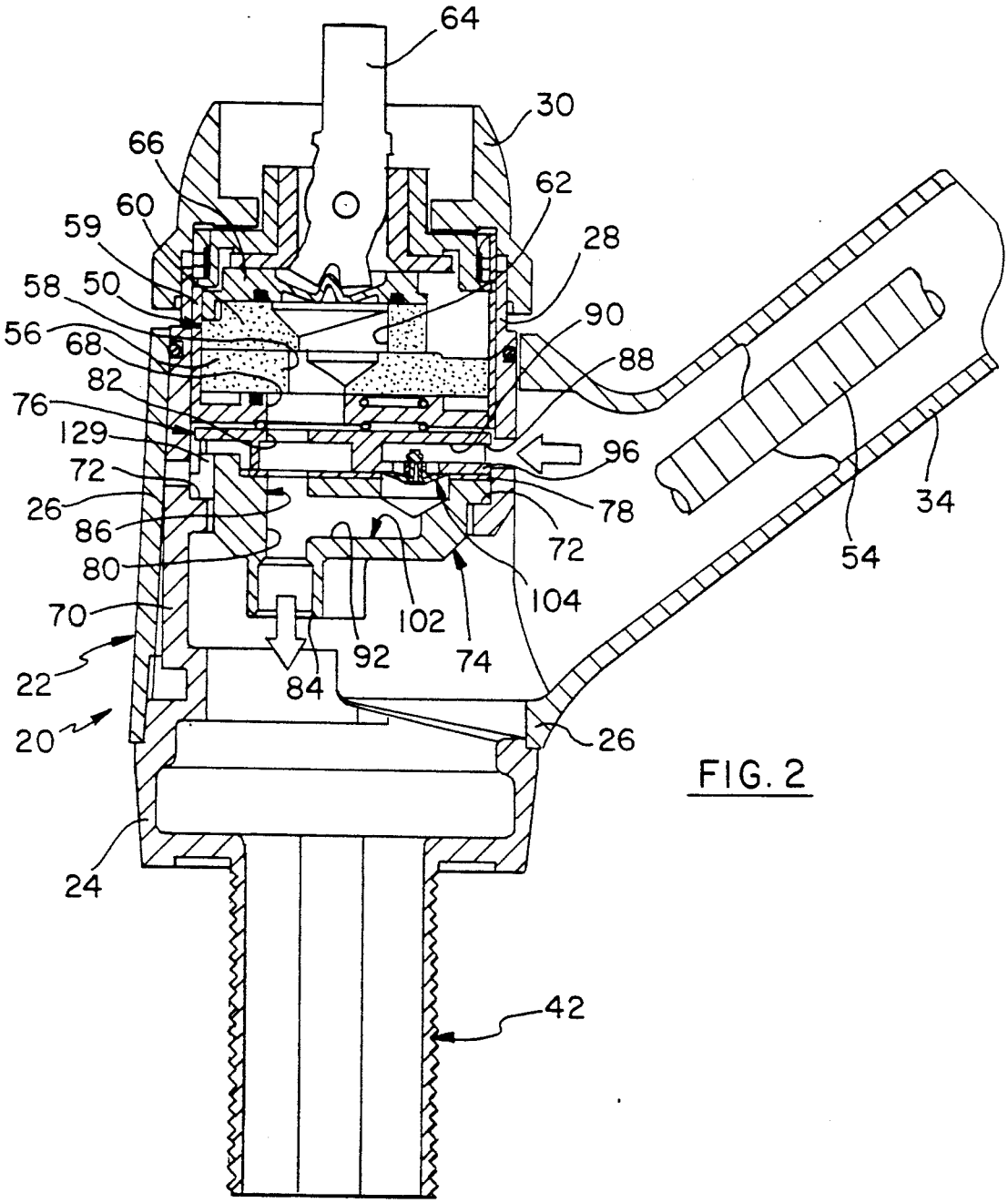
FIG. 2 is a sectional view of the faucet system of FIG. 1 showing a manifold in assembly with a module having a vacuum breaker assembled therewith in accordance with certain principles of the invention.

Referring to FIG. 2, valve 50 includes a fixed ceramic disc 56 having a fluid flow opening 58 which is located within a valve housing 59 within valve body 28. Valve 50 also includes a movable ceramic disc 60 which is located atop fixed disc 56 and which is formed with a fluid flow opening 62. A lever 64 is coupled through a moving element 66 to movable disc 66. Lever 64 is attached to handle 32 (FIG. 1) to facilitate selective movement of movable disc 60 relative to fixed disc 56.

Fixed disc 56 is formed with a pair of spaced passages (not shown) which provide a path for the fluids of inlet conduits 46 and 48. The upper ports of the spaced passages of fixed disc 56 are covered by movable disc 60 when valve 50 is conditioned to prevent the flow of fluid through fluid flow system 20. Upon selective movement of movable disc 60, either or both of the spaced passages of fixed disc 56 are uncovered to allow fluid to move from either or both inlet conduits 46 and 48 into opening 62 of the movable disc. In this manner, either hot or cold water or a selected mixture of hot and cold water will develop in opening 62. Valve housing 59 is formed with an opening 68 which allows fluid to exit valve 50 from opening 62.

Referring further to FIG. 2, base 24 of assembly 22 is formed with an upper extension 70 within hub 26 which is located near but spaced from the bottom of valve body 28. A ledge 72 is formed on the inner wall of extension 70 which provides support for a manifold 74. A module 76 is positioned atop manifold 74 with a gasket 78 therebetween. Manifold 74 and module 76 are mounted within assembly 22 in a fixed position and do not move at any time while they are so mounted. However, the manner of mounting module 76 within assembly 22 facilitates ready removal of the module therefrom should it be necessary to do so.

Manifold 74 is formed with a fluid path 80 which is aligned with a fluid path 82 formed in the module 76. Fluid path 82 is adjacent and aligned with opening 68 and opening 58 of valve 50 so that fluid passing through the open valve is conducted through module 76 and manifold 74 to an outlet port 84 at the base of the manifold. Thus, fluid paths 80 and 82 form a fluid flow path 86 of fluid flow system 20 and is included in outlet conduit 52 is coupled to port 84 a means for conducting the fluid between inlet and outlet flow lines.

Module 76 is formed with a port 88 which is located adjacent the space between the upper portion 70 of base 24 and the lower end of valve body 28. Port 88 is positioned to be adjacent a pressurized environment such as, for example, atmospheric pressure. Module 76 is further formed with a module passageway 90 which communicates with port 88 and also communicates with a manifold passageway 92 formed in manifold 74. Manifold passageway 92 also communicates with fluid path 80 of manifold 74 and thereby with fluid flow path 86 of fluid flow system 20.

Figure 10:
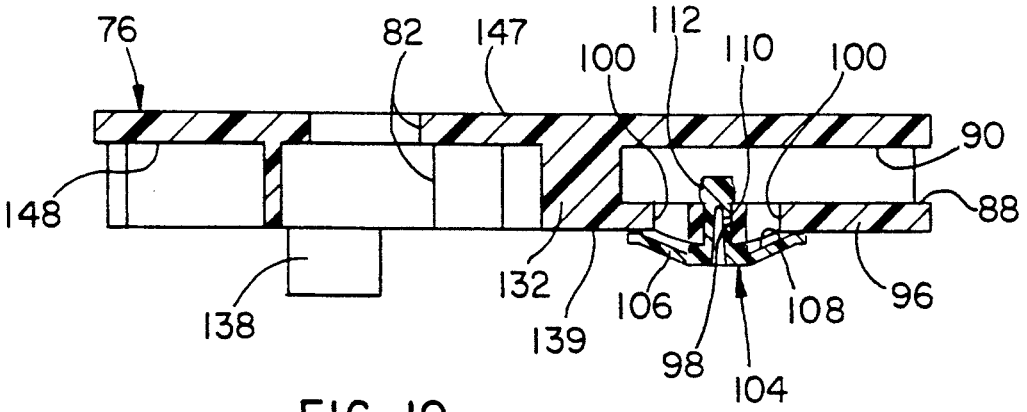
FIG. 10 is a sectional view taken along lines 10—10 of FIG. 6 showing interior structure of the module in assembly with an umbrella valve in accordance with certain principles of the invention.
Figure 7:
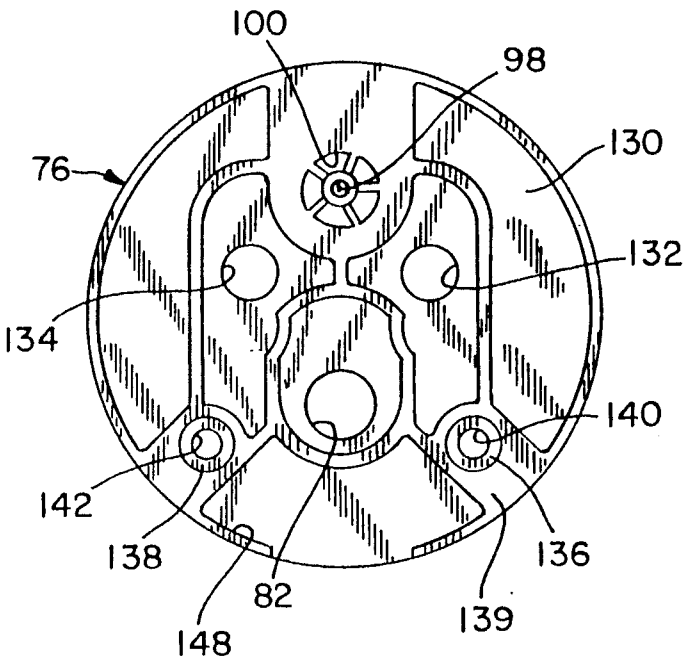
FIG. 7 is a bottom view of the module.

As illustrated in FIGS. 2, 7 and 10, a wall 96 of module 76 which interfaces with gasket 78 is formed with a central through- hole 98 and a plurality of through-ports 100 arranged radially about the through-hole. Through-hole 98 communicates with both passageways 90 and 92. Through-ports 100 also communicate with passageways 90 and 92 and, together with passageways 90 and 92, form a passageway, such as a linking passageway 102 which extends between fluid flow path 80 and port 88.

A flexible valve, such as a passageway valve 104, commonly referred to as an umbrella valve, is formed with a dish-shaped portion 106 having a concave surface 108. A stem 110 extends centrally from concave surface 108 and is formed with an enlarged head 112 at the opposite end thereof. Stem 110 is located within through-hole 98 with concave surface 108 facing wall 96 and enlarged head 112 being located on the opposite side of the wall within passageway 90. In this manner, valve 104 is retained with module 76 in such a manner that the dish-shaped portion covers through-ports 100 to effectively seal the linking passageway 102 and thereby normally preclude coupling of the fluid flow path 86 to the pressurized environment.

In normal operation of fluid flow system 20, if the pressure of the fluid at the supply thereof is greater than the pressure of the pressurized environment, for example atmospheric pressure, fluid will be supplied through open valve 50, fluid flow path 86 and dispensed from spray head 36. Since the pressure of the fluid supply is greater than the pressure of the pressurized environment, the fluid supply pressure is considered to be positive and passageway valve 104 is thereby urged to its normal position to seal through-ports 100. This precludes the coupling of the pressurized environment to fluid flow path 86 and allows the fluid to proceed to spray head 36 to be dispensed therefrom.

On occasion, dirty dishes are deposited in fluid, such as water, in the sink whereby the water becomes dirty. As each dish is cleaned, spray head 36 is withdrawn from spout 34 and button 40 is operated to dispense water in the spray mode to rinse the dish. At times, spray head 36 is placed in the dirty water while the water is being supplied through nozzle 38 in either the spray or stream mode. If, during this period, the pressure of the water supply drops below the pressure level of the pressurized environment, the water supply level is considered to be negative. Under this condition, the dirty water is literally drawn from the sink and, by reverse flow, flows from the sink and into the water supply whereby the potable water supply becomes contaminated.

It is noted that negative pressure conditions can result from a sudden and major demand for water from the supply, e.g. a fire emergency. Also, a large break in the main water line or excessive simultaneous demands by users of the water supply system can cause negative pressure to develop.

When a negative pressure develops in the fluid supply associated with fluid flow system 20, a reverse differential in pressure develops between the negative pressure of the supply and the higher pressure of the pressurized environment, such as atmospheric pressure. This pressure differential causes dish-shaped portion 106 of passageway valve 104 to be drawn away from through-ports 100 to thereby couple fluid flow path 86 to the pressurized environment. In this manner, the effects of the negative pressure is neutralized and the flow of water in the reverse direction from the dirty water of the sink is precluded.

Figure 5:
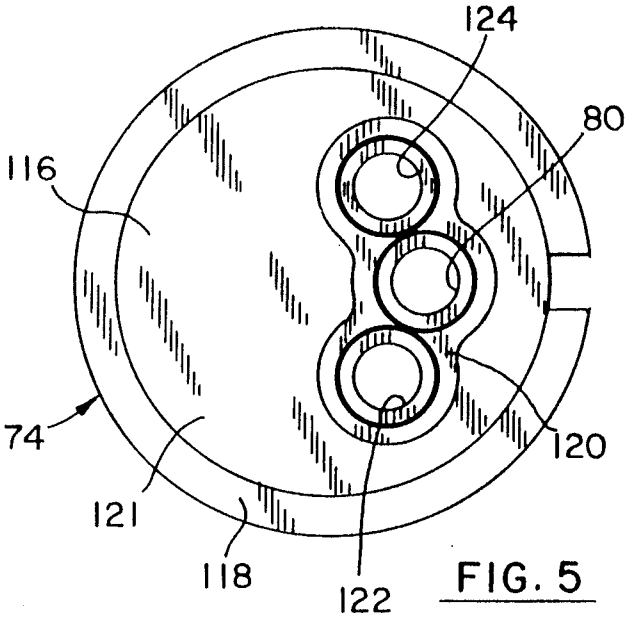
FIG. 5 is a bottom view of the manifold.
Figure 4:
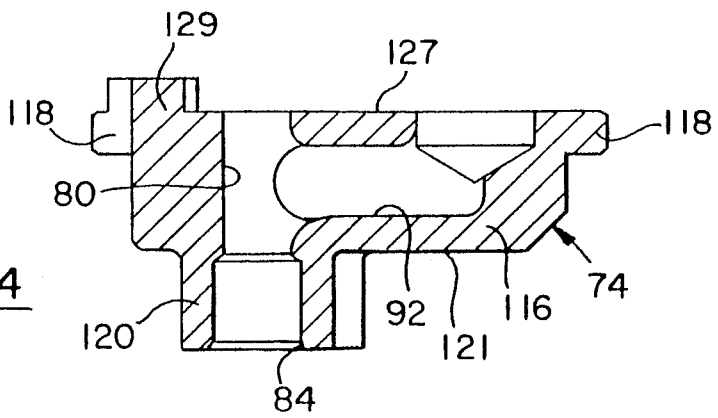
FIG. 4 is a sectional view taken along lines 4—4 of FIG. 3 showing various passages formed in the manifold in accordance with certain principles of the invention.
Figure 3:
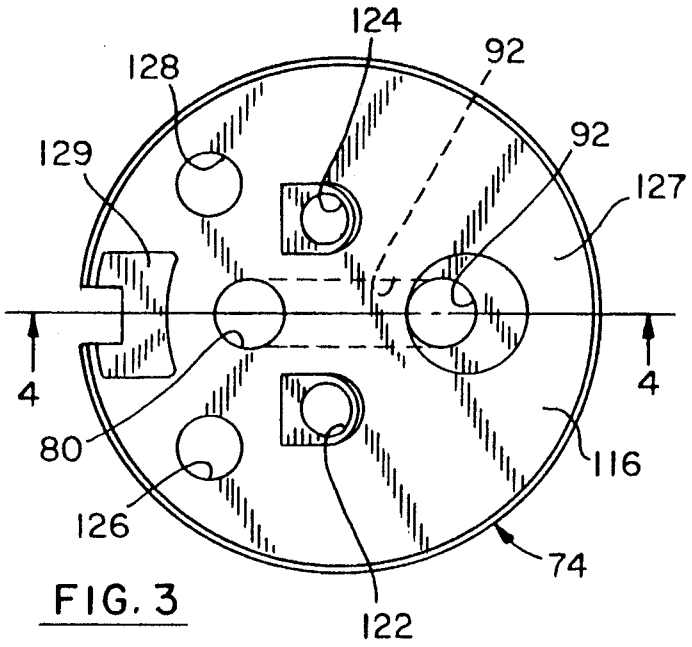
FIG. 3 is a top view of the manifold of FIG. 2.

Referring now to FIGS. 3, 4 and 5, manifold 74 includes a generally circular body 116 which is formed with an annular rim 118 overhanging the body. Body 116 is formed with a hub 120 which extends downwardly from a lower surface 121 of the body. Fluid path 80 is formed through body 116 and hub 120 as shown particularly in FIG. 4. The underside of body 116 is shown in FIG. 5 and illustrates two apertures 122 and 124 which provide passages for the inlet side of the hot and cold water. Body 116 is also formed with a pair of guide holes 126 and 128 in an upper side 127 thereof and which do not extend through the body. An upwardly extending projection 129 is formed on upper side 127 near an edge of body 116.

Figure 6:
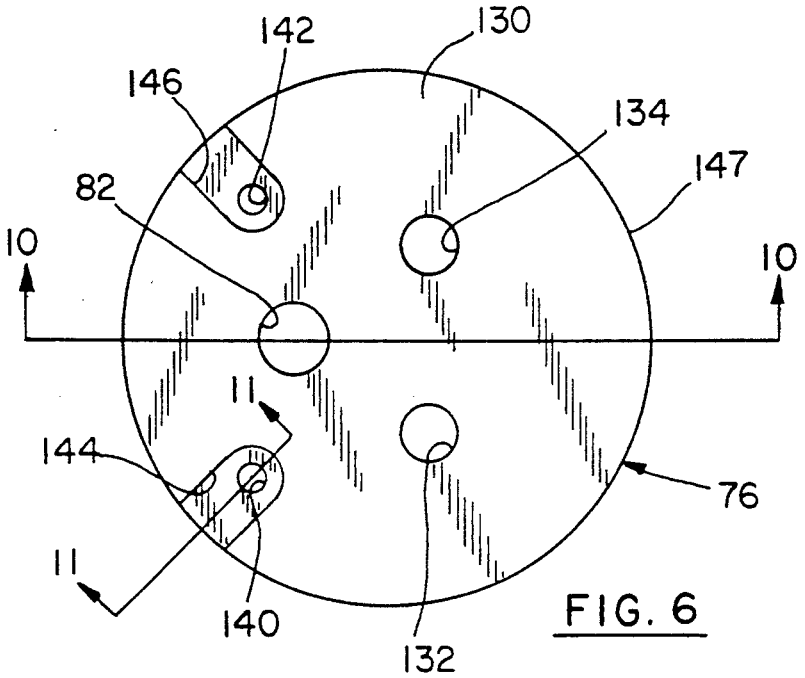
FIG. 6 is a top view of the module.
Figure 11:
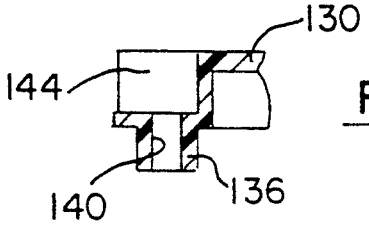
FIG. 11 is a sectional view taken along lines 11—11 of FIG. 6 showing a post of the module.
Figure 8:
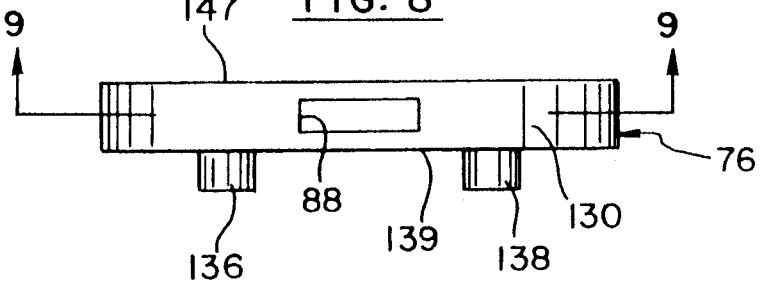
FIG. 8 is a side view of the module in accordance with certain principles of the invention.
Figure 9:
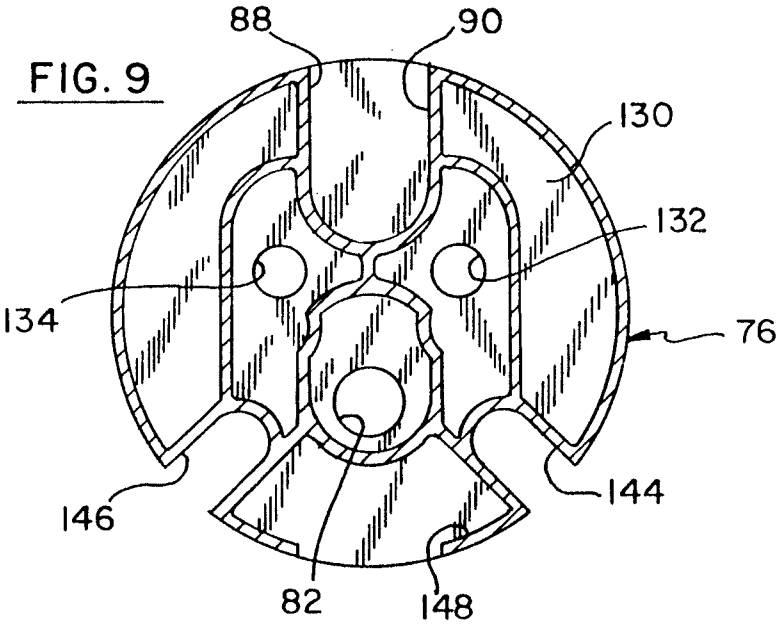
FIG. 9 is a sectional view taken along lines 9—9 of FIG. 8 showing interior structure of the module in accordance with certain principles of the invention.

Referring now to FIGS. 6, 7 and 9, module 76 is formed with a body 130 in which is formed fluid path 82, port 88, passageway 90, through-hole 98 and through-ports 100. Also, a pair of apertures 132 and 134 are formed through body 130 and are aligned with apertures 122 and 124 of manifold 74 upon assembly to provide passages for the incoming hot and cold water to valve 50. A pair of spaced posts 136 and 138 extend downwardly from a bottom surface 139 of body 130 and are formed with through-holes 140 and 142, respectively, as illustrated in FIGS. 8 and 11. Body 130 is formed with a pair of open spaces 144 and 146 in a top surface 147 thereof which communicate with through-holes 140 and 142, respectively, as shown in FIGS. 6 and 11. As shown in FIGS. 7, 9 and 10, an opening 148 is formed in bottom surface 139 and through the adjacent side edge of body 130.

In assembling manifold 74 and module 76 as a part of fluid flow system 20, valve 50 and the facilities related to handle 32 are removed to expose the hollow shell within hub 26. Manifold 74 is then inserted within the shell of hub 26 so that rim 118 of the manifold rests on ledge 72 of base 24 as illustrated in FIG. 2. Gasket 78 is then placed atop manifold 74 also as shown in FIG. 2. Thereafter, module 76, with valve 104 assembled as described above, is inserted into the shell of hub 26 so that posts 136 and 138 of the module are inserted into guide holes 126 and 128, respectively, of manifold 74. Also, opening 148 of module 76 is located over projection 129 of manifold 74. In this assembly of manifold 74 and module 76, valve 104 is aligned with manifold passageway 92 and module fluid path 82 is aligned with manifold fluid path 80 to form fluid flow path 86. Valve 50 and facilities related to handle 32 are reassembled in place as illustrated in FIG. 2.

It is noted that passageway valve 104 is located to avoid any movement at any time except during periods of negative pressure within the water or fluid supply as noted above. In particular, movement of the parts associated with valve 50 do not cause any movement of passageway valve 104.

Further, module 76 is located within fluid flow system 20 in such a manner that it can be removed easily if there is a need to replace valve 104. This places valve 104 in a highly accessible location and requires replacement of the valve only and of no other parts. In contrast, the system illustrated in U.S. Pat. No. 4,696,322 requires that the entire main valve unit be replaced if the flapper valve is defective and requires replacement of the flapper valve and its supporting structure if the main valve unit is defective and requires replacement.

The above-described embodiment, of course, is not to be construed as limiting the breadth of the present invention. Modifications, and other alternative constructions, will be apparent which are within the spirit and scope of the invention as defined in the appended claims.

What is claimed is:

1. A fluid flow system having a vacuum breaker, which comprises:

a base having an upper extension;

an inlet flow line for receiving and conducting fluid therethrough;

an outlet flow line for receiving and conducting fluid therefrom;

a valve housing mounted in an upper portion of the upper extension of the base;

a valve mounted within the valve housing and interposed between the inlet flow line and the outlet flow line for controlling selective passage of fluid through the fluid flow system;

a module assembled removably in a fixed position within an intermediate portion of the upper extension of the base below the valve and within the fluid flow system independently of the housing and the valve and formed with a module fluid path;

a manifold assembled removably in a fixed position within the intermediate portion of the upper extension of the base below the module and within the fluid flow system independently of the housing and the valve and formed with a manifold fluid path; the module fluid path and the manifold fluid path being in communication to form a fluid flow path therethrough;

the fluid flow path being positioned for conducting the flow of fluid in a first direction from the valve to the outlet flow line upon the application of a positive pressure sufficient to cause the fluid to flow in the first direction;

the module and the manifold each formed with a non-fluid-flow passageway which are in communication with each other to form a linking passageway between a pressurized environment externally of the fluid flow system and the fluid flow path; and means, removably mounted in a fixed position within the linking passageway during use of the fluid flow system and responsive to development of a negative pressure sufficient to cause fluid to flow in a direction opposite the first direction from the outlet flow line through the fluid flow path and out of the inlet flow line, for coupling the fluid flow path to a pressurized environment which neutralizes the effect of the negative pressure and precludes the flow of fluid in the direction opposite the first direction.

2. The fluid flow system as set forth in claim 1, which further comprises:

the valve being interposed between the inlet flow line and the outlet flow line independently of the module, the manifold and the coupling means.

3. The Fluid flow system as set for the in claim 1 wherein the coupling means comprises:

a valve positioned in the passageway and responsive to the presence of the positive pressure for blocking the passageway and responsive to the presence of the negative pressure for opening the passageway to couple the fluid flow path to the pressurized environment.

4. The fluid flow system as set forth in claim 1 wherein an intermediate portion of the linking passageway is formed with a through-port and wherein the coupling means includes a dish-shaped portion which is positionable over the through-port to seal or open the through-port in response to the presence of the positive pressure or the negative pressure, respectively.

5. The fluid flow system as set forth in claim 1 wherein:

an intermediate portion of the linking passageway is formed with a mounting through-hole and at least one through-port adjacent the mounting through-hole;

the coupling means is an umbrella valve formed with a dish-shaped portion having a concave surface, a stem extending outwardly at one end thereof from the concave surface and an enlarged head formed at an opposite end of the stem; and the stem of the umbrella valve located within the mounting through-hole, the enlarged head being located outside of one end of the mounting through-hole and the dish-shaped portion being located outside of an opposite end of the mounting through-hole such that the dish-shaped portion is movable selectively to cover or uncover the through-port.

6. A fluid flow system having a vacuum breaker, which comprises:

a base having an upper extension;

a valve housing mounted in an upper portion of the upper extension of the base;

an inlet flow line for receiving fluid from a fluid supply and conducting the fluid through the inlet flow line;

an outlet flow line for receiving and conducting fluid therethrough;

a main valve mounted within the valve housing and interposed between the inlet flow line and the outlet flow line for controlling selective passage of fluid from the supply, through the inlet flow line, the main valve and the outlet flow line;

a module assembled removably in a fixed position within an intermediate portion of the upper extension of the base below the valve and within the fluid flow system independently of the housing and the valve and formed with a module fluid path;

a manifold assembled removably in a fixed position within the intermediate portion of the upper extension of the base below the module and within the fluid flow system independently of the housing and the valve and formed with a manifold fluid path;

the module fluid path bring in communication with the manifold fluid path to form a fluid flow path for providing a path for the flow of fluid in a first direction from the inlet flow line, through the selectively positioned main valve, through the fluid flow path and through the outlet flow line upon the application of a positive pressure to the fluid supply and the selective positioning of the main valve to allow the fluid to pass therethrough;

the module and the manifold each formed with a non-fluid-flow passageway which are in communication with each other to form a linking passageway between a pressurized environment externally of the fluid flow system and the fluid flow path;

the linking passageway being formed with a port which communicates with the pressurized environment externally of the fluid flow assembly;

the linking passageway communicating with the fluid flow path at one end of the passageway and communicating with the port at another end of the passageway whereby pressure in the environment can be communicated to the fluid flow path through the passageway; and a passageway valve located in the linking passageway for preventing communication of the pressure of the environment to the fluid flow path when the positive pressure is applied to the fluid supply and for allowing the pressure of the environment to communicate with the fluid flow path upon development of a negative pressure as applied to the fluid supply which tends to cause the fluid to flow in a direction opposite the first direction.

7. The fluid flow system as set forth in claim 6, which further comprises:

a mounting through-hole formed in the module adjacent an intermediate portion of the linking passageway;

at least one through-port formed in the module in alignment with the linking passageway adjacent the mounting through-hole; and the passageway valve attached to the mounting through-hole and located to selectively cover the through-port.

8. The fluid flow system as set forth in claim 7 wherein the passageway valve comprises:

a stem;

a dish-shaped portion formed at one end of the stem and having a concave surface facing in the direction of the stem; and an enlarged head formed at an end of the stem opposite the one end thereof.

9. The fluid flow system as set forth in claim 6 wherein the inlet flow line comprises a hot inlet line for supplying hot fluid from a hot fluid supply and a cold inlet line for supplying cold fluid from a cold fluid supply.

10. The fluid flow system as set forth in claim 9 wherein the main valve comprises:

a fixed plate formed with a pair of inlet passageways for connection to the hot inlet line and the cold inlet line for receipt of the hot fluid and cold fluid;

the fixed plate being formed with an outlet passageway which is in communication with the fluid flow path;

a movable plate positioned adjacent the fixed plate and formed with blocking surfaces which selectively block all or portions of the pair of inlet passageways of the fixed plate;

the movable plate being formed with a fluid mixing chamber which is selectively positionable over portions or all of each of the pair of inlet passageways of the fixed plate and positionable simultaneously over the outlet passageway of the fixed plate so that a selected mix of hot and cold fluid within the fluid mixing chamber can be passed through the outlet passageway of the fixed plate and into the fluid flow path; and means for selective positioning of the movable plate to allow for the flow of fluid through the main valve at the selected mix of hot and cold fluid.

11. The fluid flow system as set forth in claim 6 wherein the pressure of the environment is atmospheric pressure sufficient to neutralize the effects of the negative pressure and thereby preclude the flow of fluid in the direction opposite the first direction.

12. The fluid flow system as set forth in claim 6, which further comprises:

a dispensing head for dispensing a fluid therefrom; and means for coupling the dispensing head to the outlet flow line so that fluid flowing through the outlet flow line will flow into and be dispensed by the dispensing head.

13. The fluid flow system as set forth in claim 12 wherein the dispensing head comprises:

stream-means for dispensing the fluid in the form of a stream;

spray means for dispensing the fluid in the form of a spray; and means for selectively operating the stream means or the spray means.

14. The fluid flow system as set forth in claim 6 which further comprises:

a wall formed across an intermediate portion of the linking passageway with one surface of the wall being in communication with the fluid flow path and an opposite surface of the wall being in communication with the port;

a plurality of apertures formed through the wall in a circular pattern about a central axis;

a mounting hole formed through the wall coaxially with the central axis;

the passageway valve is an umbrella valve which comprises:

a stem;

an enlarged head formed at one end of the stem; and a dish-shaped portion formed at an end of the stem opposite the one end and formed with a normally concave surface facing the one surface of the wall, the dish-shaped portion being sufficiently flexible to permit the normally concave surface to invert to a convex surface facing the one surface of the wall; and the stem being located within the mounting hole, the enlarged head being located outside of the mounting hole adjacent the opposite surface of the wall and the dish- shaped portion being located adjacent to and in contact with the one surface of the wall to thereby cover the apertures when the concave surface is in place and out of contact with the one surface of the wall to uncover the apertures when the convex surface is in place.

* * * * *